US005839881A

United States Patent [19]

Yu

[11] Patent Number: 5,839,881

[45] Date of Patent: Nov. 24, 1998

[54] CEILING FAN HAVING A SHOCK ABSORBING MEMBER

[76] Inventor: Jack Yu, No. 109-1, Avenue 6, Lane 164, Tzong Sa Road, Da Du Hsiang, Taichung Hsien, Taiwan

[21] Appl. No.: 843,681

[22] Filed: Apr. 10, 1997

[51] Int. Cl.[6] ..... F04D 29/52; F04D 29/64

[52] U.S. Cl. ..... 416/5; 416/244 R; 277/630; 277/631; 277/632; 277/642; 277/916; 362/96; 362/369; 362/390

[58] Field of Search ..... 416/5, 170 R, 416/244 R; 220/4.21, 327, 328, 651, 653; 277/630, 631, 632, 637, 641, 642, 916; 362/96, 369, 390

[56] References Cited

U.S. PATENT DOCUMENTS

| | | | |
|---|---|---|---|
| 1,463,360 | 7/1923 | Foote | 277/641 |
| 3,738,670 | 6/1973 | Jelinek et al. | 277/632 |
| 4,206,499 | 6/1980 | Urbanek et al. | 220/327 |
| 4,290,615 | 9/1981 | Etcheverry | 277/631 |
| 4,402,649 | 9/1983 | Laurel | 416/5 |
| 4,626,970 | 12/1986 | Huang | 416/5 |
| 4,863,346 | 9/1989 | Lin | 416/5 |
| 4,936,811 | 6/1990 | Baker | 277/637 |
| 5,441,387 | 8/1995 | Yu . | |
| 5,503,524 | 4/1996 | Yu . | |
| 5,507,619 | 4/1996 | Ryan | 416/5 |

FOREIGN PATENT DOCUMENTS

| | | | |
|---|---|---|---|
| 523454 | 4/1956 | Canada | 362/390 |
| 4727 | of 1905 | United Kingdom | 416/5 |
| 1080768 | 8/1967 | United Kingdom | 220/4.21 |

*Primary Examiner*—Christopher Verdier

[57] ABSTRACT

A ceiling fan housing includes a cylindrical member having an upper and outer peripheral flange and a cover having a lower and outer peripheral flange. A disc includes an upper and a lower surfaces each having a peripheral groove for engaging with the peripheral flanges of the cylindrical member and the cover. The disc is made of shock absorbing material for absorbing shocks and vibrations that may be generated in the ceiling fan. The disc includes two or more curved members secured together by ribs and slots so as to form the disc.

2 Claims, 4 Drawing Sheets

CEILING FAN HAVING A SHOCK ABSORBING MEMBER

BACKGROUND OF THE INVENTION

1. Field of the Invention

The present invention relates to a ceiling fan, and more particularly to a ceiling fan having a shock absorbing member.

2. Description of the Prior Art

The applicant has developed various kinds of ceiling fan housings. Two of the ceiling fan housings are disclosed in U.S. Pat. No. 5,441,387 to YU, and U.S. Pat. No. 5,503,524 to YU. However, typical ceiling fan housings have no shock absorbing members for absorbing shocks and vibrations that may be generated in the ceiling fan housing.

The present invention has arisen to mitigate and/or obviate the afore-described disadvantages of the conventional ceiling fan housings.

SUMMARY OF THE INVENTION

The primary objective of the present invention is to provide a ceiling fan housing having a shock absorbing member for absorbing shocks and vibrations that may be generated in the ceiling fan housing.

In accordance with one aspect of the invention, there is provided a ceiling fan housing comprising a body including an upper and outer peripheral flange, a disc including a bore and including a lower surface having a first peripheral groove for engaging with the upper and outer peripheral flange of the body, the disc including an upper surface having a second peripheral groove, a cover including a lower and outer peripheral flange for engaging with the second peripheral groove of the disc, and means for securing the body and the disc and the cover together and for allowing the disc to form a shock absorbing member between the body and the cover.

The disc includes at least two curved members secured together, the curved members each includes a first end having a rib and the curved members each includes a second end having a slot, the ribs of the curved members are engaged with the slots of the other curved members for securing the curved members together.

The body includes a bottom and outer peripheral flange, and includes a bottom plate having an annular groove for engaging with the bottom and outer peripheral flange of the body and for allowing the bottom plate to be secured to the body Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
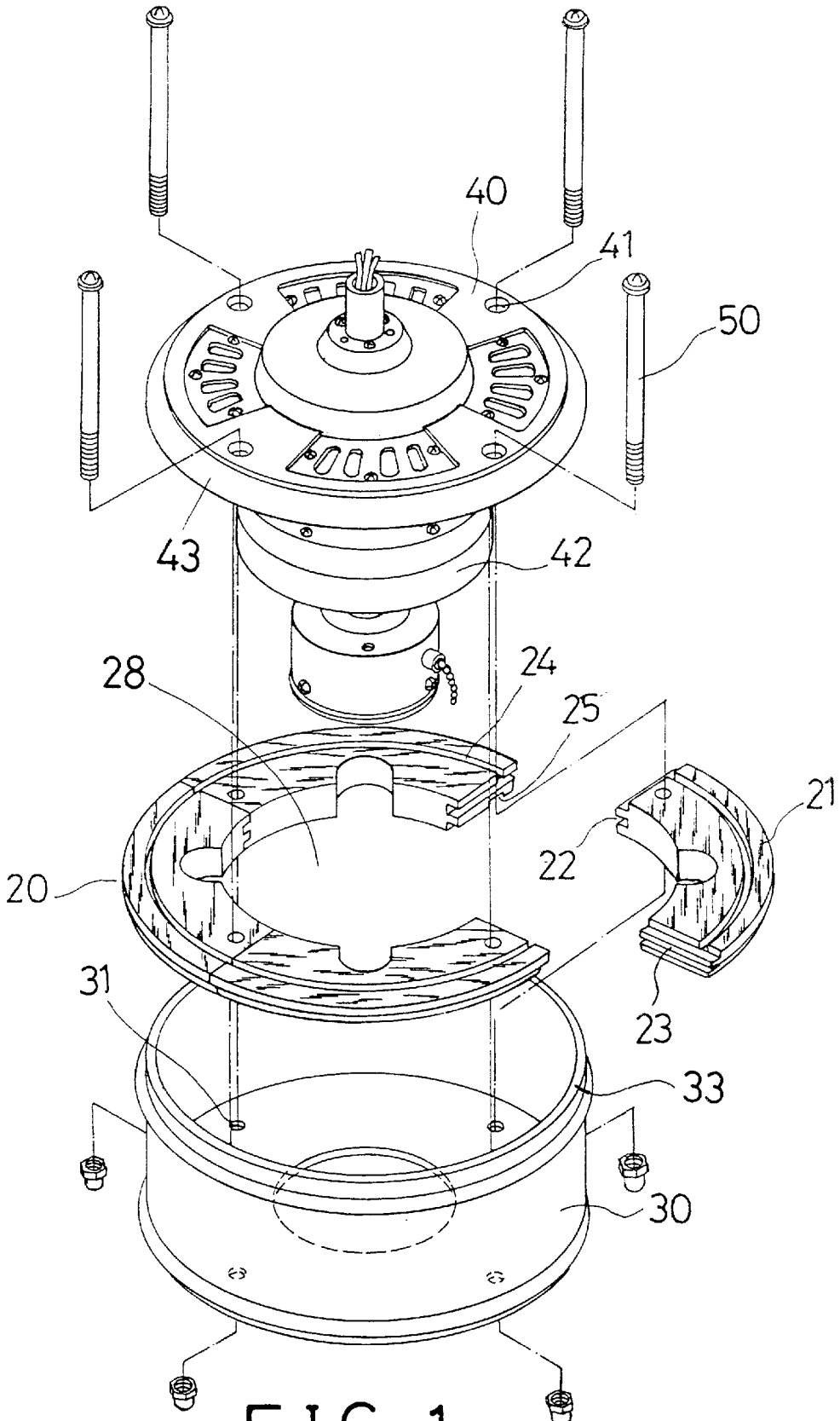
FIG. 1 is an exploded view of a ceiling fan housing in accordance with the present invention.
Figure 2:
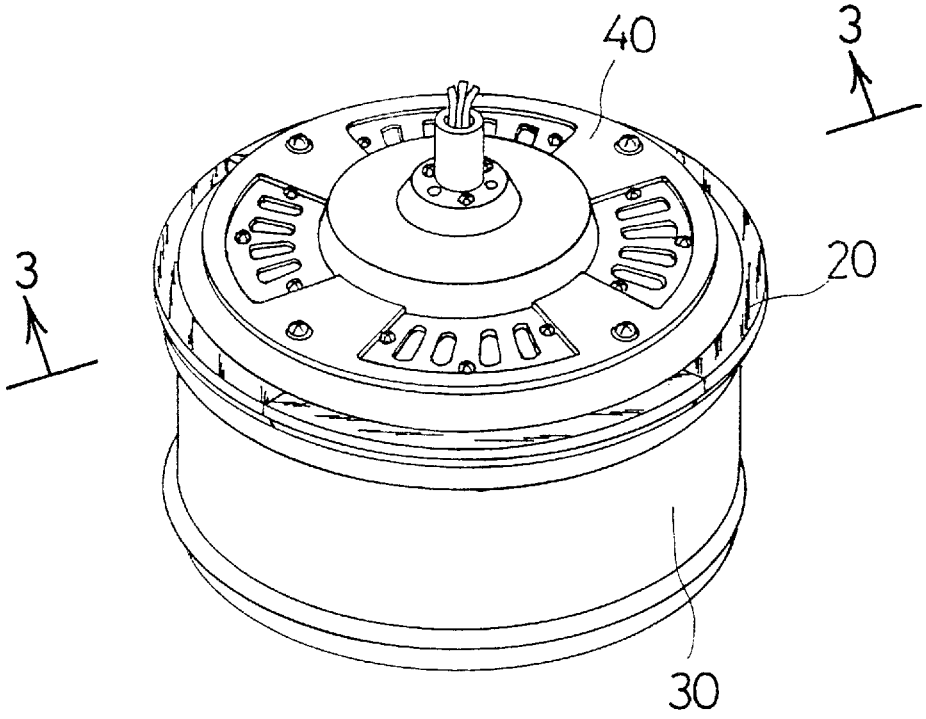
FIG. 2 is a perspective view of the ceiling fan housing.
Figure 3:
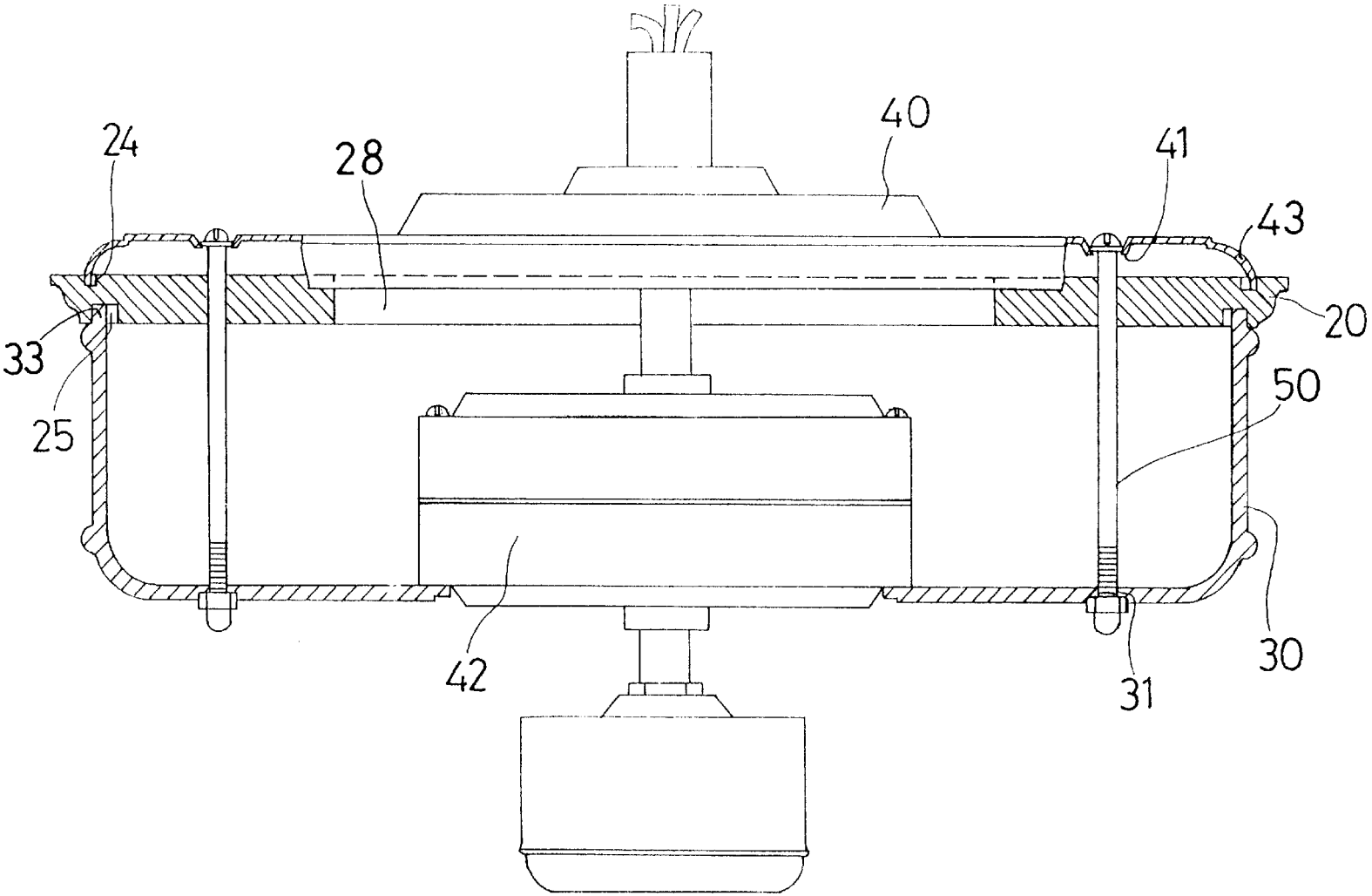
FIG. 3 is a cross sectional view taken along lines 3—3 of FIG. 2.

Referring to the drawings, and initially to FIGS. 1 to 3, a ceiling fan housing in accordance with the present invention comprises a body 30 including an upper and outer peripheral flange 33. A cover 40 includes a lower and outer peripheral flange 43 and includes a number of holes 41 for engaging with fasteners 50 which are also engaged with the holes 31 of the body 30. A motor 42 is secured to the cover 40 and received in the body 30.

A disc 20 includes a bore 28 for engaging with the motor 42 and includes an upper and a lower peripheral groove 24, 25 for engaging with the lower and outer peripheral flange 43 of the cover 40 and the upper and outer peripheral flange 33 of the body 30, best shown in FIG. 3. The disc 20 is preferably made of shock absorbing material, such as plastic, rubber, wood etc., for absorbing shocks and vibrations that may be transmitted through the body 30 and the cover 40. The disc 20 includes four curved members 21 each including two ends having ribs 23 and slots 22 for engaging with that of the other curved members 21 and for securing the curved members 21 together and to form the disc 20. The ribs 23 and the slots 22 of the curved members 21 may be secured together by force-fitting engagement. Alternatively, the disc 20 may include two or more curved members 21 secured together to form the disc shape.

Figure 4:
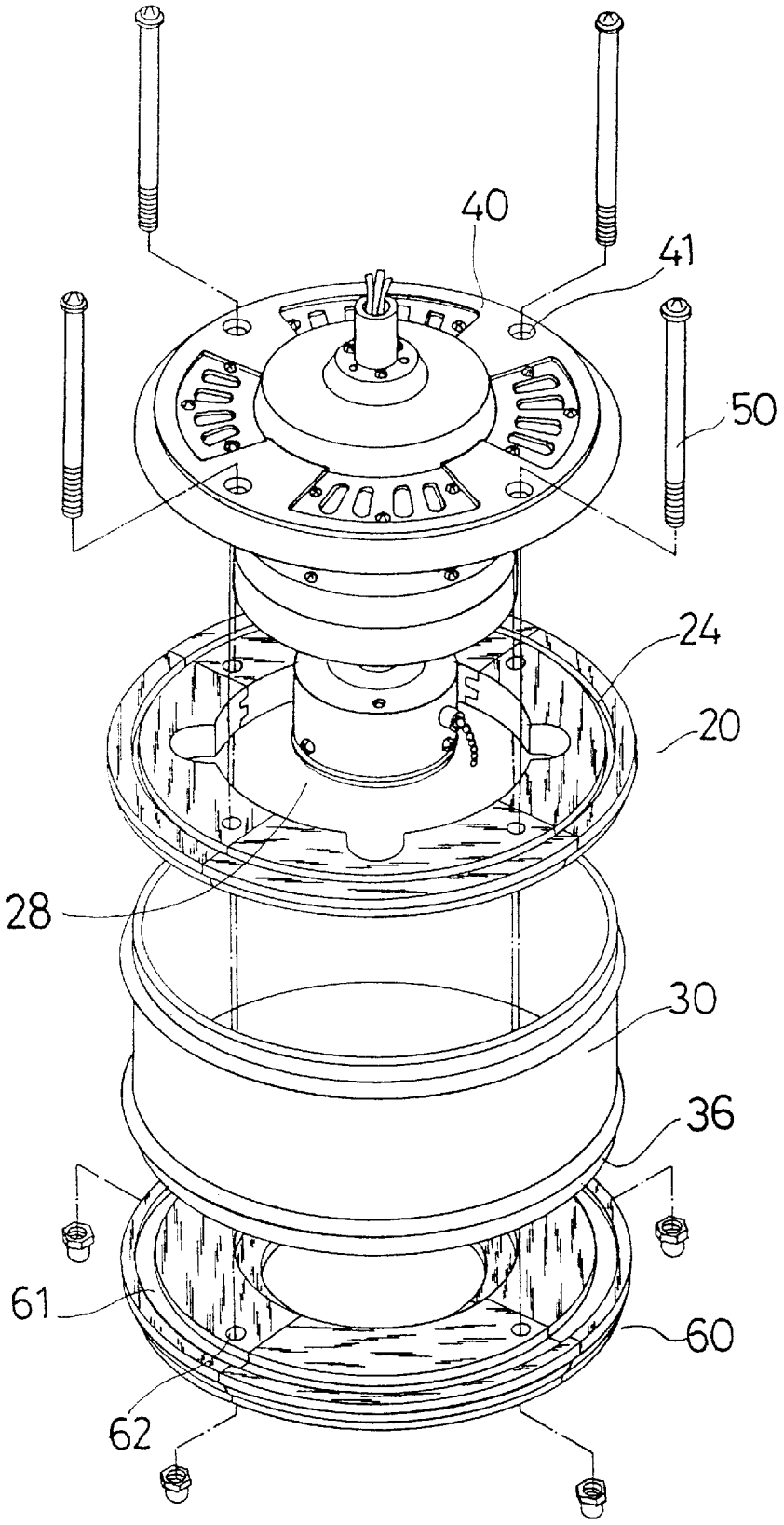
FIG. 4 is an exploded view showing another application of the ceiling fan housing in accordance with the present invention.

Referring next to FIG. 4, the body 30 may includes a lower and outer peripheral flange 36 for engaging with an annular groove 61 which is formed in the upper surface of a bottom plate 60. The fasteners 50 may engage with the holes 62 of the bottom plate 60 for securing the bottom plate 60 and the body 30 and the disc 20 and the cover 40 together. The bottom plate 60 is also preferably made of shock absorbing material for absorbing shocks and vibrations that may be generated in the ceiling fan.

Accordingly, the ceiling fan housing includes a disc 20 and/or a bottom plate 60 which may be provided for absorbing shocks and vibrations that may be generated in the ceiling fan.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan housing comprising:

a body including an upper and outer peripheral flange, said body including a bottom and outer peripheral flange and including a bottom plate having an annular groove for engaging with said bottom and outer peripheral flange of said body and for allowing said bottom plate to be secured to said body, a disc including a bore and including a lower surface having a first peripheral groove for engaging with said upper and outer peripheral flange of said body, said disc including an upper surface having a second peripheral groove, a cover including a lower and outer peripheral flange for engaging with said second peripheral groove of said disc, and means for securing said body to said cover and for allowing said disc to form a shock absorbing member.

2. A ceiling fan housing according to claim 1, wherein said disc includes at least two curved members secured together, said curved members each include a first end having a rib and said curved members each include a second end having a slot, said ribs of said curved members are engaged with said slots of the other curved members for securing said curved members together.

* * * * *